US005444990A

United States Patent [19]

McGill, III et al.

[11] Patent Number: 5,444,990

[45] Date of Patent: Aug. 29, 1995

[54] REVERSIBLE FAN ASSEMBLY PANEL FOR PACKAGE AIR CONDITIONERS AND HEAT PUMPS

[75] Inventors: Robert S. McGill, III, Murfreesboro; Timothy A. Wright, Franklin; Danny R. Burdette, Murfreesboro, all of Tenn.; Paul L. Doppel, Madison, Ala.

[73] Assignee: Inter-City Products Corporation, Lavergne, Tenn.

[21] Appl. No.: 186,669

[22] Filed: Jan. 25, 1994

[51] Int. Cl.[6] ..... F25D 19/00

[52] U.S. Cl. ..... 62/298; 62/262; 62/326; 62/77; 417/223

[58] Field of Search ..... 62/262, 298, 326, 77; 417/223

[56] References Cited

U.S. PATENT DOCUMENTS

| | | | |
|---|---|---|---|
| 2,265,272 | 12/1941 | Ditzler | 62/298 |
| 2,349,668 | 5/1944 | Marker | 415/223 |
| 3,089,315 | 5/1963 | Brandt | 62/326 |
| 3,678,993 | 7/1972 | Pierce | 165/76 |
| 3,742,725 | 7/1973 | Berger | 62/298 |
| 4,449,376 | 5/1984 | Draper | 62/259.1 |
| 4,554,796 | 11/1985 | Stankard | 62/326 |
| 4,698,982 | 10/1987 | Laios et al. | 62/286 |
| 4,805,418 | 2/1989 | Ishizuka | 62/298 |
| 5,186,528 | 2/1993 | Schardt | 312/100 |

*Primary Examiner*—John M. Sollecito
*Attorney, Agent, or Firm*—Baker & Daniels

[57] ABSTRACT

The present invention involves package air conditioner and heat pump units. The unit has a housing containing a compressor, an outdoor section with blower and heat exchanger, and an indoor section with blower and heat exchanger. The indoor section has two interchangeable removable panels, one removable panel defining a supply port and a second removable panel defining a return port. The return and supply ports of the housing are reversible because of the unique blower assembly which has a blower attached to the second panel. The blower assembly is adapted to be disposed in at least two positions in said housing. With this arrangement, the return port and the supply port are reversible by switching the position of the first panel and the blower assembly.

14 Claims, 6 Drawing Sheets

REVERSIBLE FAN ASSEMBLY PANEL FOR PACKAGE AIR CONDITIONERS AND HEAT PUMPS

BACKGROUND OF THE INVENTION

1. Field of the Invention

The present invention relates to package air conditioners and heat pumps. More particularly, the field of the invention involves single package horizontal airflow air conditioners and heat pumps.

2. Description of the Related Art

Package air conditioner and heat pump units generally comprise both indoor and outdoor coils, a compressor, and both indoor and outdoor fans. The outdoor coil and fan are disposed in communication with the outdoor ambient to circulate ambient air through the outdoor coils. The indoor coils and fan are disposed in communication with air ducts which are connected to the space being cooled or heated thereby circulating the indoor air through the indoor coils. For heat pump units, electric strip heating elements may also be disposed with the indoor fan to supplement the heating of the indoor coil when used as a condenser. Conventionally, the package units include a box shaped cabinet made of sheet metal in which the coils, fans, and compressor are located, with the cabinet including supply and return ports for connection with the corresponding supply and return air ducts of the structure being serviced.

Earlier, manufacturers of package units made no distinction as to the orientation of the supply and return duct openings. Whichever orientation was most convenient to enhance the design of the package unit was employed in the particular arrangement. This situation created a large population of package units being installed with a mix of oppositely arranged air duct openings.

More recently, manufacturers generally standardize the air duct orientation, with the return duct conventionally arranged on the left side with a diameter of about 14 inches, while the supply duct is located on the right side with a diameter of about 12 inches. Unfortunately, this conventional orientation presents a problem to installers of replacement package units with the reverse of the conventional air duct orientation. The installer must reverse the orientation of the air ducts in the structure so as to match the duct openings of the conventionally oriented replacement package unit, a practice which is costly and time consuming.

Package units are conventionally employed with mobile homes as well as with residential and commercial buildings. In the case of new installations of mobile homes, the installer may be faced with placing a new package unit on either of the long sides of the mobile home depending on how close the mobile home is to an adjacent structure or property line of the lot on which the home is located. Since the supply and return duct positions are predetermined by the mobile home manufacturer, the installer is faced with a potentially opposite orientation of ducts with respect to the package unit. Again, the installer must reverse the orientation of the air ducts in the mobile home in order to match the orientation of the package unit.

Although mobile home manufacturers and builders are attempting to adopt the conventional supply and return duct orientation, the conventional orientation has not been universally accepted. Even if all newly constructed buildings and mobile homes adopted a uniform orientation of air ducts, these problems would remain for the multitudes of already existing homes. Therefore, it would be desirable to have a package unit which could be easily installed regardless of the orientation of the duct structure.

SUMMARY OF THE INVENTION

The present invention involves a package air conditioner or heat pump which includes a reversible ducting and fan arrangement allowing the package unit to be oriented for either conventional or reverse conventional air duct orientation. One wall of the package unit is comprised of a panel, fan assembly, and port which is interchangeable with a second panel defining the other port. With the present invention, only a single type of package unit is needed for any air duct arrangement. The invention involves mounting the indoor fan on one panel defining one of the duct ports, and then removably locating that fan panel on the appropriate side for connection to the correct supply or return duct.

The present invention provides flexibility to the field installer of package units. The invention may be used with replacement units, so that regardless of the type of structure or the orientation of its ducts the package unit may be arranged compatibly. For new structures, the present invention provides a package unit which is as secure as a fixed orientation unit while only requiring a single model. Further, changing the orientation of the supply and return ports, and the corresponding repositioning of the indoor fan, is simply and easily accomplished with the present invention.

The present invention also includes additional features which enhance the basic design of a package unit. The supply and return ports are formed by adjustable collars which facilitate the connection of the package unit with the duct structure. The panel and fan assembly may include electric strip heating to enhance the heating ability of the package heat pump. The package unit includes support blocks for the indoor fan so that the weight of the fan and its optional strip heating does not cause undue stress on the panel structure. The panel and fan assembly further includes a catch on the bottom of the fan portion to prevent damage when the panel and fan assembly is installed or removed.

The present invention is, in one form, a package air conditioner comprising a housing, a compressor, indoor and outdoor heat exchangers, and indoor and outdoor blowers. The housing is divided into at least an indoor section and an outdoor section. The housing defines an exterior surface which includes two interchangeable, removable panels, a first removable panel defining a supply port and a second removable panel defining a return port. The compressor is disposed within the housing and is connected with the outdoor heat exchanger and indoor heat exchanger. The outdoor heat exchanger and outdoor blower are disposed in the outdoor section. The indoor heat exchanger is disposed in the indoor section. The package air conditioner also includes a blower assembly having a blower attached to the second panel. The blower assembly is adapted to be disposed in at least two positions in the housing. With this arrangement, the return and supply ports are reversible by switching the position of the first panel and blower assembly.

The present invention is, in another form, a reversible blower assembly for use in a package air conditioner that has a housing with at least two rectangular openings of approximately equal sizes. The reversible blower assembly comprises a panel and an attached blower. The panel has a generally rectangular exterior surface corresponding to the size of the rectangular opening of the package air conditioner housing, with a port. The blower is attached to the panel, and has an outlet connected with the port and an inlet.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

The preferred embodiment disclosed below is not intended to be exhaustive or limit the invention to the precise form disclosed in the following detailed description. Rather, the embodiment is chosen and described so that others skilled in the art may utilize its teachings.

Figure 1:
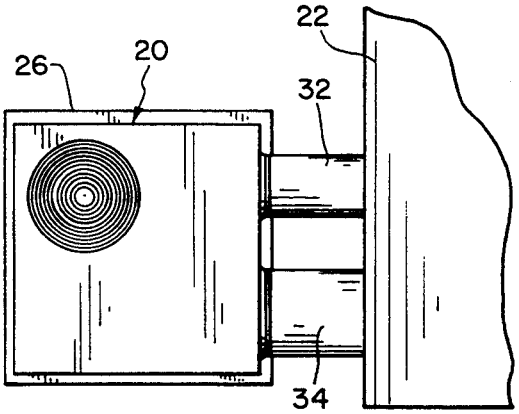
FIG. 1 is a top view of a package unit of the present invention attached to a building in a conventional orientation.
Figure 2:
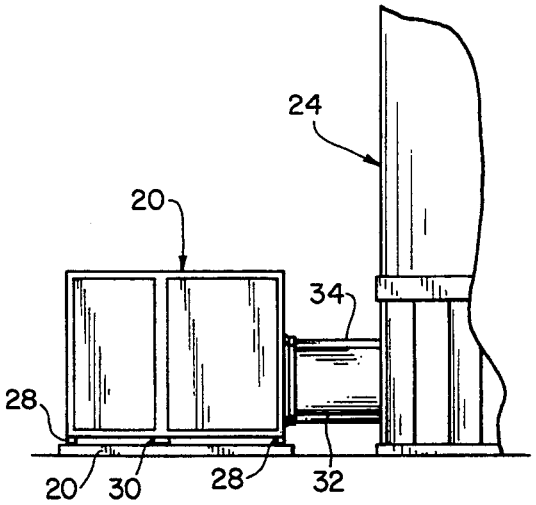
FIG. 2 is a side view of a package unit of the present invention attached to a mobile home in the reverse conventional orientation.
Figure 5:
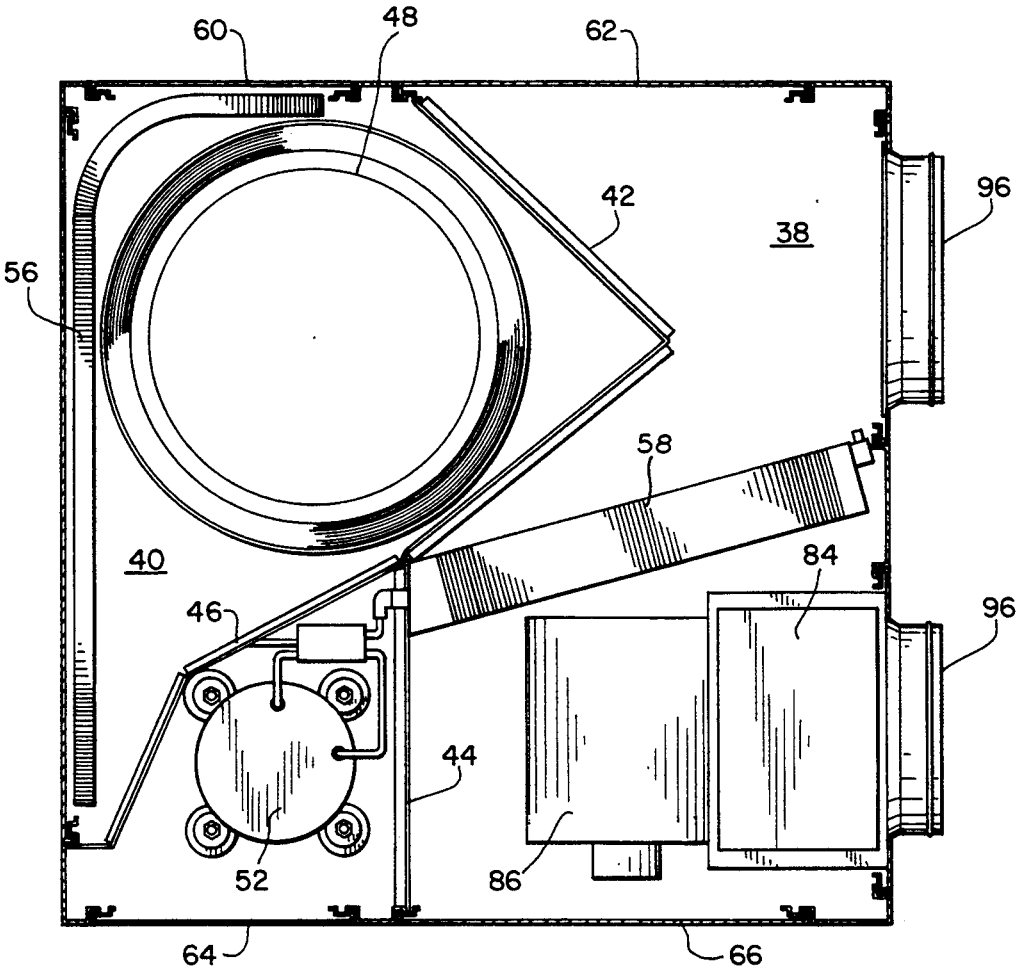
FIG. 5 is a top view of the package unit with the cover removed.

The present invention is shown as package air conditioner or heat pump unit 20 which is attached to a structure such as a building 22 (FIG. 1) or mobile home 24 (FIG. 2). Unit 20 is supported on a separate concrete slab 26 by side rails 28 and base pan support rail 30. Supply duct 32 and return duct 34 connect unit 20 to the air circulation system (not shown) of building 22 or mobile home 24. Although ducts 32 and 34 often are disposed under a protective cover so that unwanted heat transfer with the ambient air is minimized, ducts 32 and 34 are shown without a cover in the Figures. As discussed in greater detail below, conventionally supply duct 30 has a smaller diameter than the diameter of return duct 32, and the two ducts are arranged differently for conventional and reverse conventional orientations.

Unit 20 includes housing 36 which is divided into indoor side 38 and outdoor side 40 by partition panels 42, 44, and 46. Partition panel 42 forms a fan shroud for outdoor blower 48, while partition panels 44 and 46 define working space 50 for accommodating compressor 52 and reversing valve 54, although reversing valve 54 is only present in heat pumps. Housing 36 also includes various refrigerant fluid conduits (not numbered) which fluidly connect compressor 52, reversing valve 54 (when present), outdoor heat exchanger coils 56, and indoor heat exchanger coils 58. The sides of housing 36 comprise removable side panels 60, 62, 64, and 66 which are preferably made in accordance with the removable access panel structure disclosed in U.S. Pat. No. 5,186,528, entitled "REMOVABLE ACCESS PANELS FOR ROOFTOP UNIT" filed on Mar. 29, 1991, Ser. No. 07/677,234, assigned to the assignee of the present invention, the disclosure of which is incorporated by reference. Side panel 60 may be an open grille if outdoor heat exchanger 56 extends around outdoor blower 48, and one side of housing 38 comprises grille 68 which protects outdoor heat exchanger 56. Base pans (unnumbered) support the contents of unit 20, and top panel 70 covers its interior, panel 70 including blower orifice 72 which is protected by top discharge grille 74.

The present invention relates to the portions of unit 20 which are coupled to the supply and return ducts of the structure being heated or cooled. Housing 38 includes two approximately equally sized rectangular openings which are capable of being covered by either return panel 76 or blower assembly 78. Return panel 76 is similar to the other side panels except that it includes return port 80 for connecting unit 20 with return duct 34. Blower assembly 78 comprises supply panel 82, heater box 84, and circulation blower 86. Supply panel 82 is similar to the other side panels except that it includes supply port 88 and it is attached to heater box 84. Heater box 84 may contain electric strip heating elements (not shown) when blower assembly 78 is utilized in a heat pump. Circulation blower 86 may be a conventional squirrel cage type blower which induces an air flow into its center and exhausts the air through heater box 84.

Figure 3:
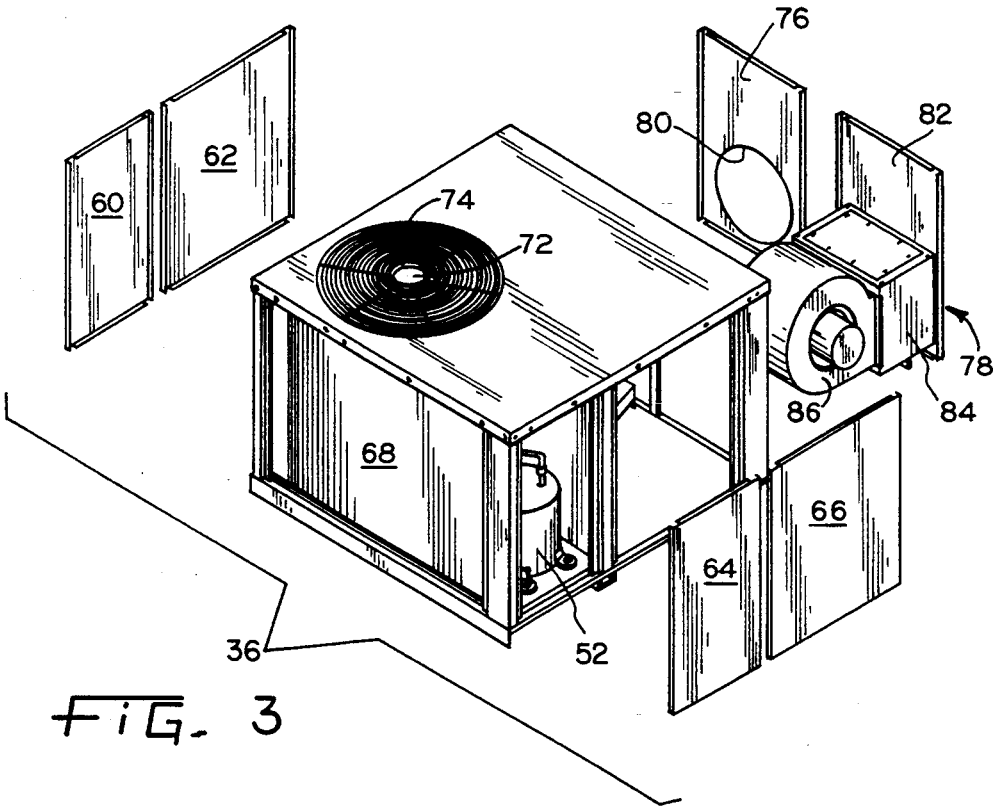
FIG. 3 is an exploded view of the package unit in the conventional orientation.
Figure 4:
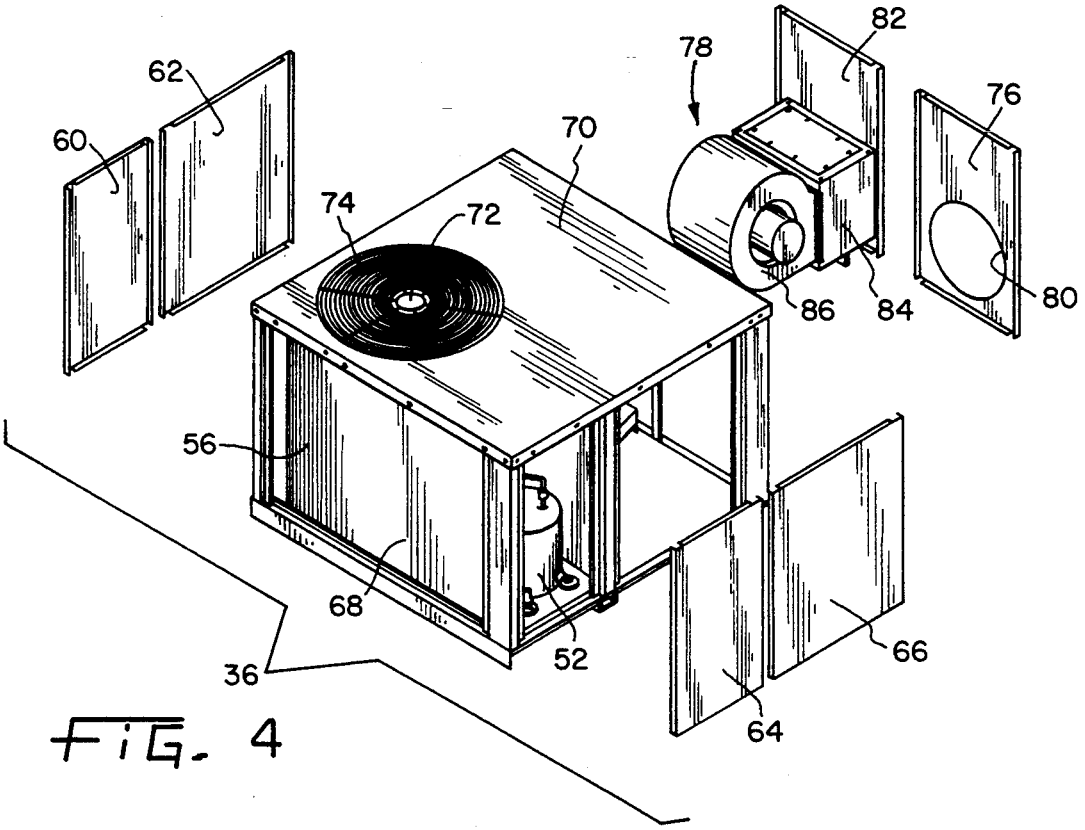
FIG. 4 is an exploded view of the package unit in the reverse conventional orientation.

FIGS. 3 and 4 show exploded views of unit 20 with blower assembly 78 being positioned on either side of indoor heat exchanger 58. Side panels 62 and 66 serve as access panels to blower assembly 78, although in operation the panels partially define the air circulation space of indoor section 38 of unit 20. Circulation blower 86 induces air flow into both of its sides, regardless of which side of indoor heat exchanger 58 blower 86 is disposed, to cause air circulation within indoor section 38. The resulting airflow enters indoor side 38 through return port 80, traverses through heat exchanger coils 58, into circulation blower 86, then through heater box 84, and out through supply port 88. Thus, the indoor air is drawn into unit 20 and through the heating or cooling heat exchanger coils 58 before being expelled from blower 86. Optionally, heater box 84 may include internally disposed electric strip heating elements to heat the indoor air.

FIGS. 11–15 depict the method of removing blower assembly 78 from access opening 90 of housing 36. Access opening 90 represents either of the two approximately equally sized rectangular openings in housing 36 through which indoor section 38 is connected to the air ducts of the structure being serviced. The installation of blower assembly 78 into access opening 90 is essentially the reverse process, and so for simplicity of explanation only the removal process is discussed in detail below. First, the electrical connections to the blower motor must be disconnected, and the mechanical connections securing supply panel 82 with housing 36 must be removed. The person removing assembly 78 should be positioned directly in front of supply panel 82, and should wear protective gloves to guard against contact with the sheet metal of housing 36 and panel 82.

Figure 11:
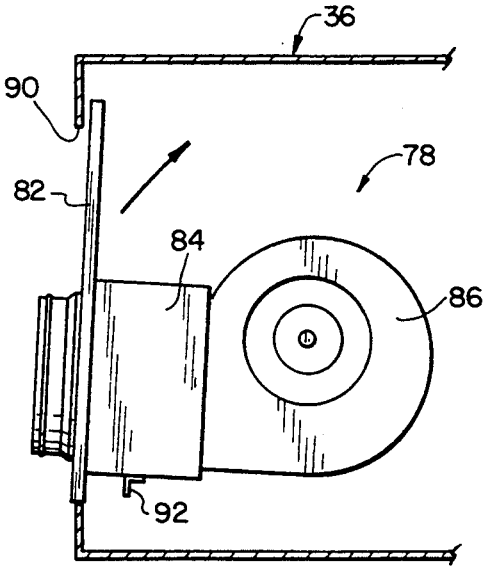
FIGS. 11–15 are side views showing the removal of the reversible fan assembly from the cabinet.
Figure 12:
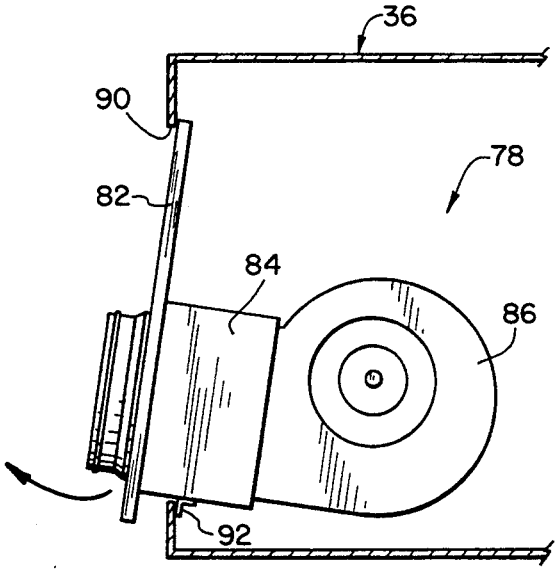
Figure 13:
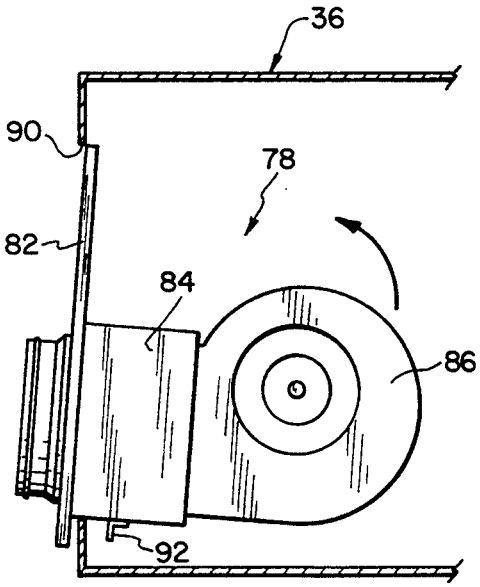
Figure 14:
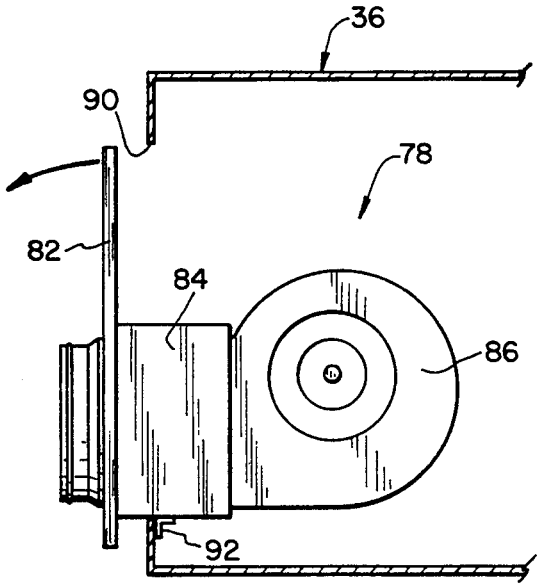
Figure 15:
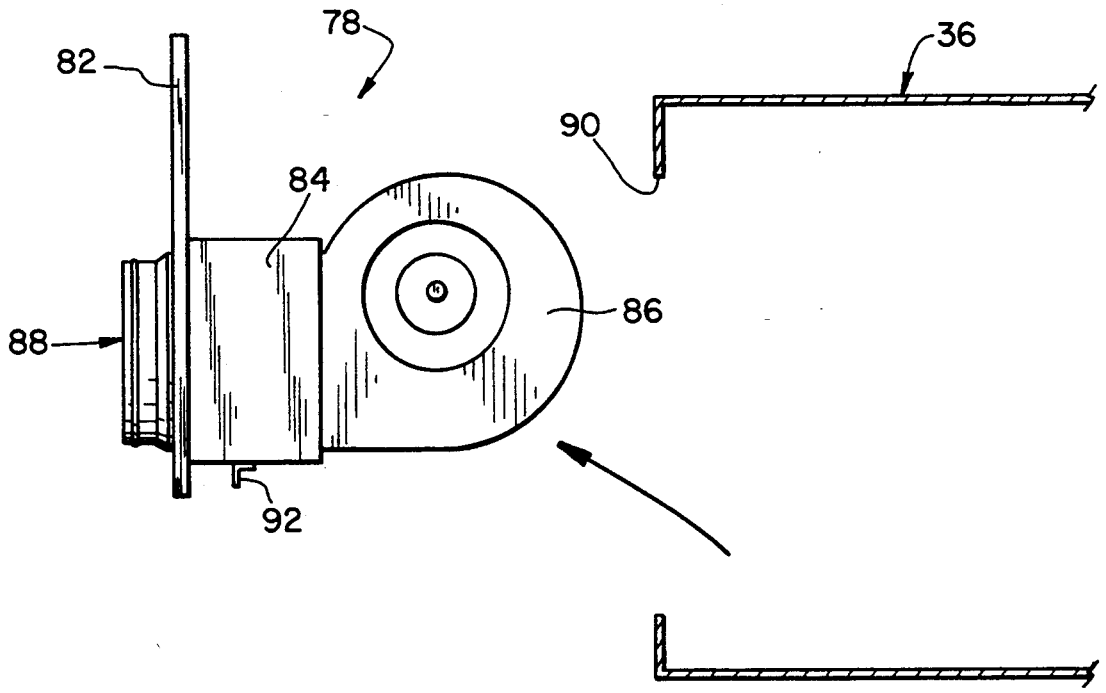

As shown in FIG. 11, assembly 78 is initially lifted upwards. Once the lower edge of panel 82 rises above the lower edge of opening 90, assembly 78 may be pivoted away from housing 36 until bracket 92 blocks further pivoting, see FIG. 12. Bracket or catch 92 is attached to the lower surface of heater box 84 and extends downwardly to block any further pivoting motion. With the lower edge of panel 82 having cleared the lower edge of opening 90, assembly 78 is then pushed back slightly so that bracket 92 is slightly distanced from the lower edge of opening 90. Resting the lower surface of heater box 84 on the lower edge of opening 90 allows the upper edge of panel 82 to clear the upper edge of opening 90 as shown in FIG. 13. From the position of FIG. 13, the top edge of panel 82 may be pivoted out of opening 90 so that all of panel 82 is located outside of housing 36. This allows the upward lifting of assembly 78 so that its remaining portions—namely heater box 84 and blower 86—may be removed from housing 36 as shown in FIG. 15.

Figure 10:
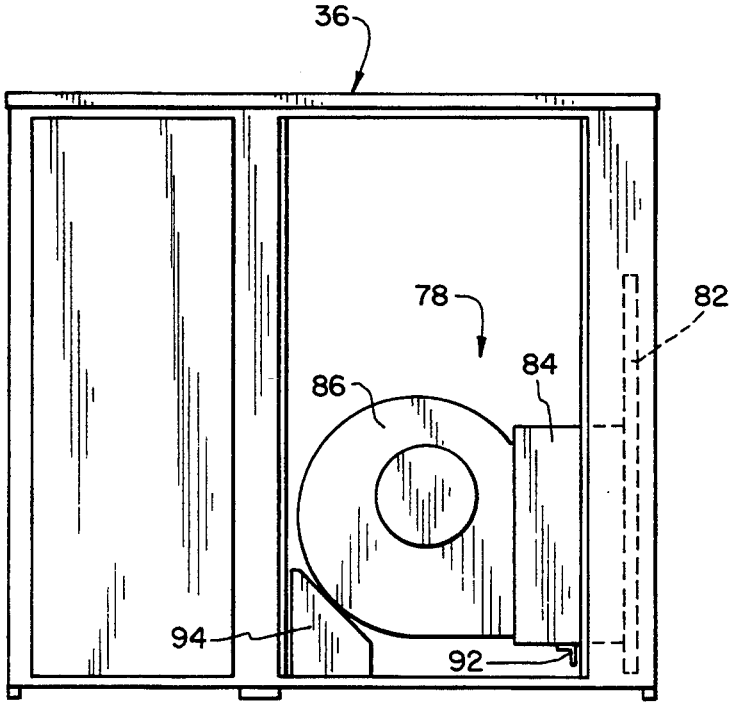
FIG. 10 is a side view of the package unit with a side panel removed showing the blower support block.

Another aspect of the invention involves blower support block 94 as shown in FIG. 10. Block 94 provides support to the weight of blower 86 at its end which extends away from supply panel 82. Without block 94, the attachment of heater box 84 and blower 86 would tend to be stressed which may ultimately result in damage to blower assembly 78. Also, block 94 is attached to a base pan of housing 36 and stabilizes the physical position of blower 86 during its operation and absorbs vibrations, thus minimizing the noise and vibrations transmitted back into the attached structure through the air ducts. In the preferred embodiment, each portion of indoor side 38 includes one of block 94 so that a block 94 supports blower assembly 78 in either of its two positions.

Figure 6:
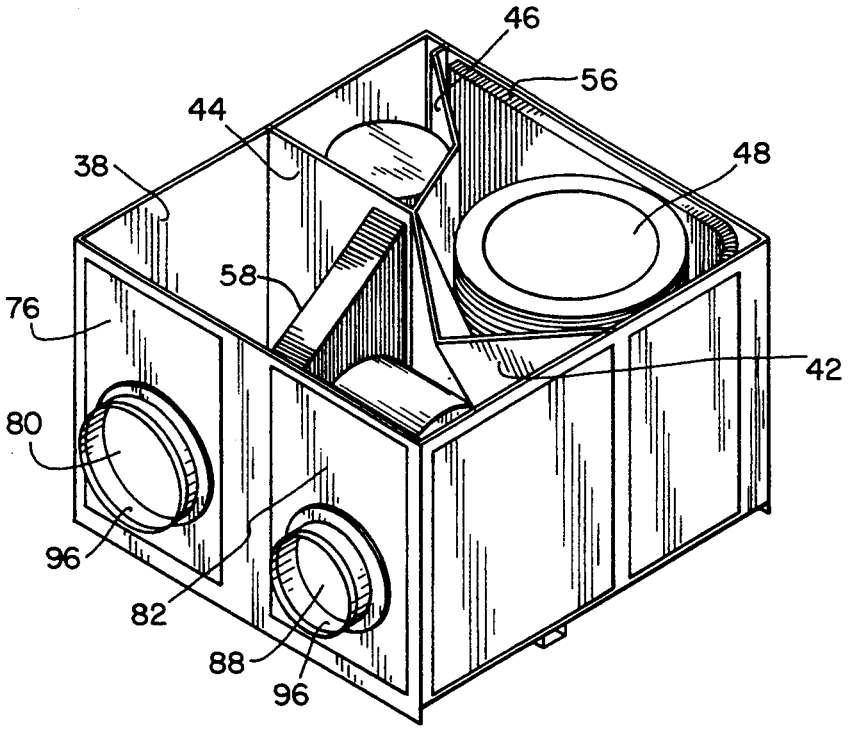
FIG. 6 is a perspective view of the package unit with the cover removed.
Figure 7:
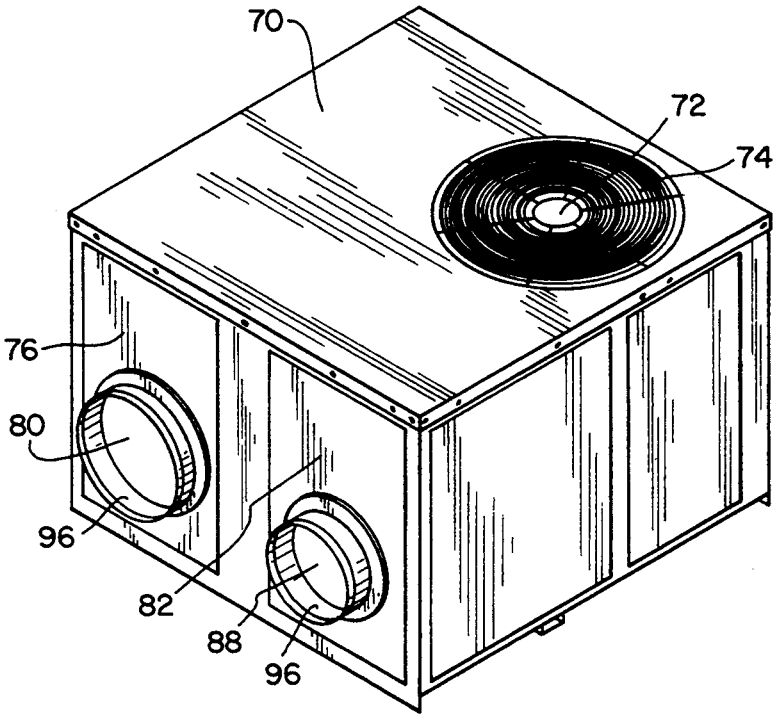
FIG. 7 is a perspective view of the package unit with the cover in place.
Figure 8:
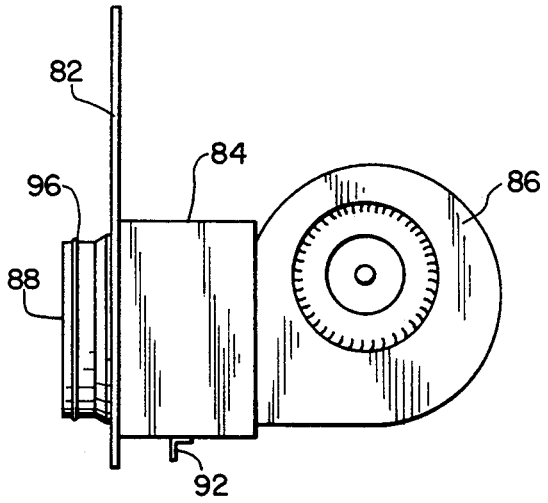
FIG. 8 is a side view of the reversible fan assembly of the present invention.
Figure 9:
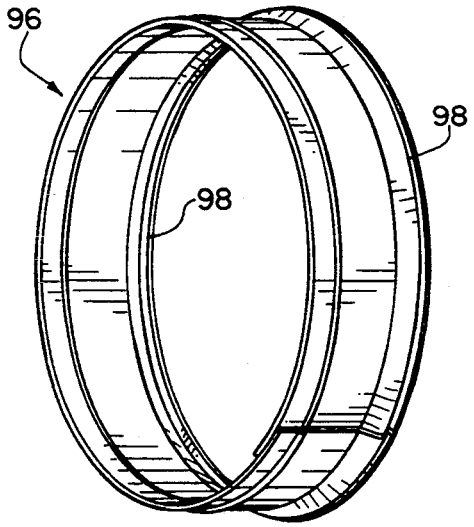
FIG. 9 is a perspective view of a duct attachment ring of the present invention.

To facilitate connection with air ducts, the present invention includes duct collars 96 for mounting in supply port 88 and return port 80. FIGS. 6 and 7 show duct collars 96 mounted in the ports, and FIG. 9 shows a single duct collar 96 unattached. Collars 96 include substantially V-shaped flanges 98 at one end which engage the outer peripheries of the attached ports. Collars 96 comprise sheet metal strips formed into a circular shape, with the ends of the strips overlapping to close the circle. This structure allows for the circular shape to be compressed to less than the size of the port opening, inserted into the port opening, and then expanded so that V-shaped flange 98 engages the periphery of the port opening. A screw or other fastener is then used to connect the ends together and maintain the connection to the panel. Collars 96 may be stored in housing 36 during shipment, thereby preventing damage to collars 96 which may otherwise occur during shipment.

Package unit 20 is adaptable to many different configurations, for example, 2 ton, 2½ ton, 3 ton, 3½ ton, 4 ton, and 5 ton versions. The different configurations vary in the size of the outdoor and indoor heat exchanger coils 56 and 58, the size of compressor 52, and the sizes of blowers 48 and 86. Additionally, the length of outdoor heat exchanger 56 may extend as far as to fill the opening covered by side panel 60, in which case an air grille rather than a side panel would be used in its position. Housing 36 is primarily constructed of sheet metal, and the air conditioning and heat pump components of unit 20 are of conventional design and construction.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A package air conditioner comprising:

a housing divided into at least an indoor section and an outdoor section, said housing defining an exterior surface which includes first and second interchangeable removable panels respectively positioned in first and second positions in said housing, said first removable panel defining a supply port of conditioned air and said second removable panel defining a return port of conditioned air, said supply port and said return port being in communication with said indoor section;

a compressor disposed within said housing;

an outdoor heat exchanger and an outdoor blower disposed in said outdoor section;

an indoor heat exchanger disposed in said indoor section;

said compressor being connected with said outdoor heat exchanger and said indoor heat exchanger; and a blower assembly including a blower attached to said second panel, said blower assembly adapted to be selectively disposed in said first position or said second position whereby said return port and said supply port are reversible by selectively positioning said first panel and said second panel.

2. The package air conditioner of claim 1 further including a reversing valve connecting said compressor with said outdoor heat exchanger and said indoor heat exchanger whereby said package air conditioner is capable of operation as a heat pump.

3. The package air conditioner of claim 2 wherein said blower assembly further includes an electric heating element.

4. The package air conditioner of claim 1 wherein said indoor compartment includes first and second blower supporting portions supporting said blower of said blower assembly whereby the weight of said blower is supported in both said first and second positions.

5. The package air conditioner of claim 1 further comprising first and second duct collars respectively disposed in said supply and return ports for attaching said supply and return ports with corresponding air ducts.

6. The package air conditioner of claim 5 wherein said first and second duct collars each include a generally V-shaped flange for engaging said supply and return ports, respectively.

7. The package air conditioner of claim 1 wherein said indoor heat exchanger is located in said indoor compartment between said first and second positions in said housing such that said blower is disposed on a first side of said indoor heat exchanger when said second panel is located in said first position and said blower is disposed on a second side of said indoor heat exchanger when said second panel and blower assembly is located in said second position.

8. The package air conditioner of claim 1 wherein said first and second panels are rectangular and have upper and lower edges, said housing defines first and second rectangular openings having a smaller height than the height of said first and second panels, and said blower assembly includes a catch portion attached to said blower and extending downwardly.

9. An air conditioner comprising:

a reversible blower assembly for moving conditioned air;

a housing including at least two rectangular openings of approximately equal size;

said blower assembly including a panel having a generally rectangular exterior surface corresponding to the size of said at least two rectangular openings, said panel also defining a port; and a blower attached to said panel, said blower having an outlet connected with said port, and an inlet;

whereby said blower assembly may be selectively mounted in either said first or second openings to selectively reverse the flow of conditioned air through said first and second openings.

10. The air conditioner of claim 9 further comprising an electric heating element.

11. The air conditioner of claim 9 further comprising a collar disposed in said port for attaching said port with a corresponding air duct.

12. The air conditioners of claim 11 wherein said collar includes a generally V-shaped flange for engaging said port.

13. The air conditioner of claim 9 wherein said panel has an upper and a lower edge, the rectangular opening having a smaller height than the height of said panel, said blower assembly further comprising a catch portion attached to said blower extending downwardly.

14. The air conditioner of claim 9 wherein said inlet is disposed substantially transversely in relation to said panel.

* * * * *

UNITED STATES PATENT AND TRADEMARK OFFICE

CERTIFICATE OF CORRECTION

PATENT NO. : 5,444,990

DATED : August 29, 1995

INVENTOR(S) : Robert S. McGill, III et al

It is certified that error appears in the above-indentified patent and that said Letters Patent is hereby corrected as shown below:

On the title page, item [73], delete "Inter-City Products Corporation" and substitute therefor --Inter-City Products Corporation (USA)--.

Signed and Sealed this

Twelfth Day of December, 1995

*Attest:*

*Attesting Officer*

BRUCE LEHMAN

*Commissioner of Patents and Trademarks*